US006112831A

United States Patent [19]

Gustafsson

[11] Patent Number: 6,112,831

[45] Date of Patent: Sep. 5, 2000

[54] HANDLE FRAME FOR PERCUSSIVE HAND HELD MACHINES

[75] Inventor: Lennart Gustafsson, Kalmar, Sweden

[73] Assignee: Atlas Copco Berema Aktiebolag, Nacka, Sweden

[21] Appl. No.: 08/983,236

[22] PCT Filed: Jul. 4, 1996

[86] PCT No.: PCT/SE96/00914

§ 371 Date: May 4, 1998

§ 102(e) Date: May 4, 1998

[87] PCT Pub. No.: WO97/02930

PCT Pub. Date: Jan. 30, 1997

[30] Foreign Application Priority Data

Jul. 13, 1995 [SE] Sweden ..... 9502593
Jul. 13, 1995 [SE] Sweden ..... 9502594

[51] Int. Cl.[7] ..... B25D 17/04

[52] U.S. Cl. ..... 173/162.2; 173/170

[58] Field of Search ..... 173/162.1, 162.2, 173/170, 210, 211

[56] References Cited

U.S. PATENT DOCUMENTS

| | | | |
|---|---|---|---|
| 2,430,817 | 11/1947 | Jackson . | |
| 3,451,492 | 6/1969 | Ekström et al. | 173/162.2 |
| 3,990,523 | 11/1976 | Schramm et al. . | |
| 4,282,938 | 8/1981 | Minamidate . | |
| 4,912,848 | 4/1990 | Bidanset | 173/162.2 |
| 5,285,858 | 2/1994 | Okada et al. | 173/211 |
| 5,462,127 | 10/1995 | Svensson | 173/162.1 |

FOREIGN PATENT DOCUMENTS

| | | |
|---|---|---|
| 104 154 | 3/1984 | European Pat. Off. . |

*Primary Examiner*—Scott A. Smith
*Attorney, Agent, or Firm*—Frishauf, Holtz, Goodman, Langer & Chick, P.C.

[57] ABSTRACT

A handle frame (20;20[1];120) for a portable power tool, wherein the portable power tool comprises a housing (10), a hammer mechanism (13) provided in the housing (10), and an elongate working implement (12) having an impact receiving end extending into the housing (10) for receiving impacts in a longitudinal direction from the hammer mechanism (13). The handle frame includes two parallel elongate side members (21) disposed on opposite sides of the housing (10) and extending in a first plane (x—x) parallel to a tool application direction, each of the side members (21) having a forward end portion (21*a*) located in the tool application direction and a rear end portion (21*b*) located in a direction opposite to the tool application direction. Mountings (16,17) are provided on the side members (21) for connecting the handle frame to the housing (10) of the portable power tool in a vibration damped manner. Two handgrips (18) laterally extend from the side members (21) for enabling manual support and control of the portable power tool during operation. A forward arcuate cross-member (23) interconnects the forward end portions (21*a*) of the side members (21), and a rear arcuate cross-member (22) interconnects the rear end portions (21*b*) of the side members (21). The forward cross-member (23) is disposed in a second plane (y—y) forming an angle with the first plane (x—x), and the forward cross-member (23) has a larger extent in a direction perpendicular to the tool application direction than the housing (10) of the portable power tool, thereby forming an auxiliary handgrip and protecting the housing (10) of the portable power tool.

12 Claims, 6 Drawing Sheets

Fig. 2
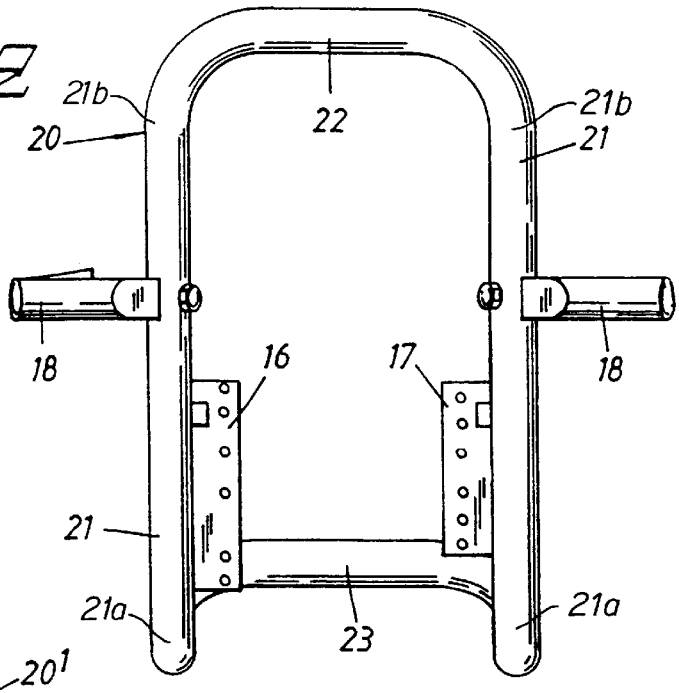
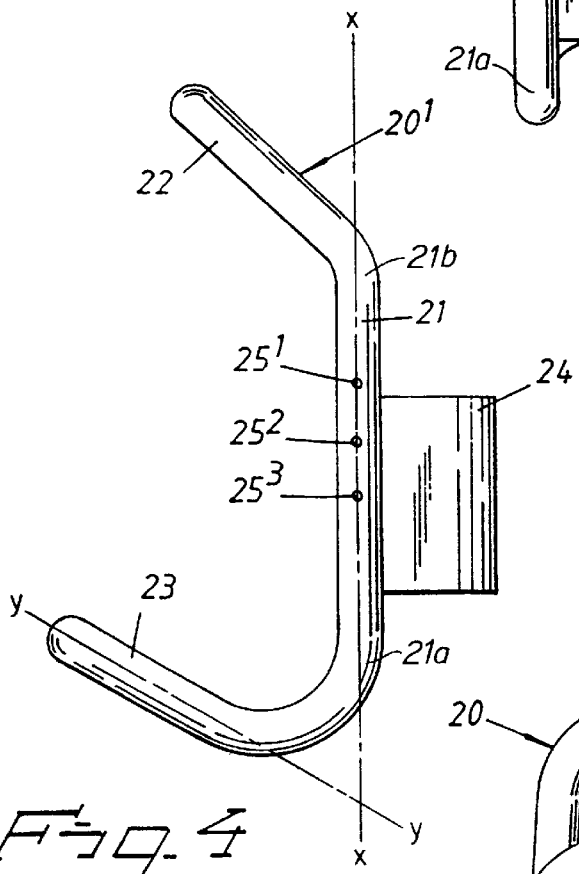
Fig. 4
Fig. 3
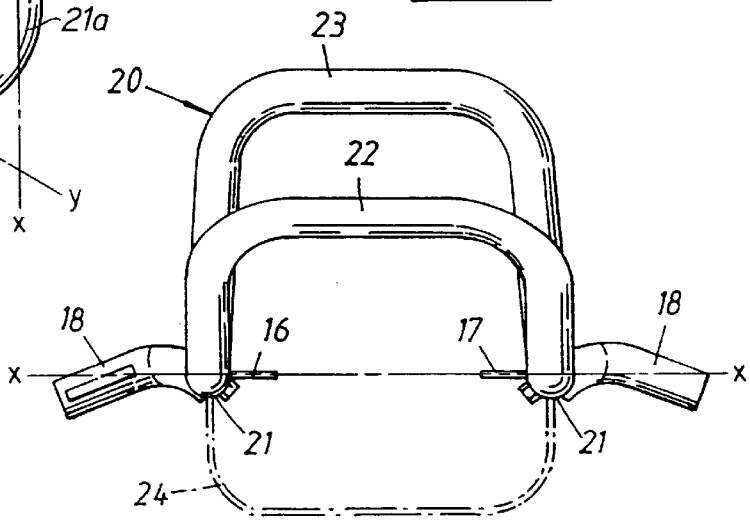

HANDLE FRAME FOR PERCUSSIVE HAND HELD MACHINES

The present invention relates to a handle frame for percussive hand held machines of the type comprising a machine housing with a hammer mechanism therein adapted to repeatedly impact against a working tool projecting out from said machine housing, such a handle frame is connected to the machine housing through the medium of a vibration damper, has handgrips that project outwardly, and is adapted for vibration suppressed feeding by hand of said machine housing in the longitudinal direction of said working tool.

BACKGROUND OF THE INVENTION

As typical examples of such handle frames there can be referred to patent publications U.S. Pat. No. 3,451,492 (SE 226 416) and EP 0 104 154. The handle frames disclose therein fulfill an acceptably adapted function substantially only at the feed proper however, while moving to a new place or a new point of tool application, due to the imbalanced weight distribution of the machine in relation to the handle frame, the machine housing has to be touched directly for purposes of shifting the position upward or to the side. This demands contacting parts of the machine that are unsuited for being touched i.e. vibrating parts and parts that due to operation have turned hot or become dirty. That is inconvenient and tiring for the operator and involves risk for injuries. In particular in combustion engine driven percussive machines there is produced heat that radiates out both from the motor and the hammer mechanism. The weight-saving compact build-up of hand held machines normally leads to that the fuel tank is placed near the motor, conventionally often with the tank made of a plastic material, and that involves the risk of the tank swelling, the danger of spill against hot parts from cracked tanks and during fueling, and disturbances by fuel pressed out into the fuel system or the environment when the tank becomes overheated.

OBJECT OF THE INVENTION

An object of the invention, in handle means of the above-mentioned type, is to create an outer handle frame through which handling and directing of the machine will be effectively improved. As a benefit is attained, that all necessary actuating points during normal working operations around the machine housing become vibration suppressed while direct contact with the machine during any form of handling is obviated, whereby shifting of the working positions can be performed conveniently, without risk, and with increased safety for the operator. At the same time the inventive handle frame, due to its spacing in assembled state relative to the machine and in particular in cases when the hammer mechanism's drive is a combustion motor, is well suited to be formed as a tight highly strong tubular fuel tank for the motor, which increases the safety against heating of the fuel and fire set to spilled fuel. The overpressure in such case can be locked safely within the tank without risk for formation of cracks, so that fuel spill to the environment and overflooding of the motor interior from the tank via the carburetor is avoided. In a robust normal embodiment, the handle frame furthermore functions as an impact absorbing protection if the machine happens to fall from upright working position or is carelessly treated during transportation. The objects accounted for above are attained by the characterizing features of the claims following hereinafter.

BRIEF DESCRIPTION OF THE DRAWINGS

FIG. 2 shows the handle frame in FIG. 1 alone, removed from the breaker.

FIG. 3 shows a top view of the handle frame and indicates by broken lines an alternative embodiment.

FIG. 4 shows a side view of the handle frame in the alternative embodiment of FIG. 3 and with a laterally directed handgrip removed.

DETAILED DESCRIPTION

Figure 1:
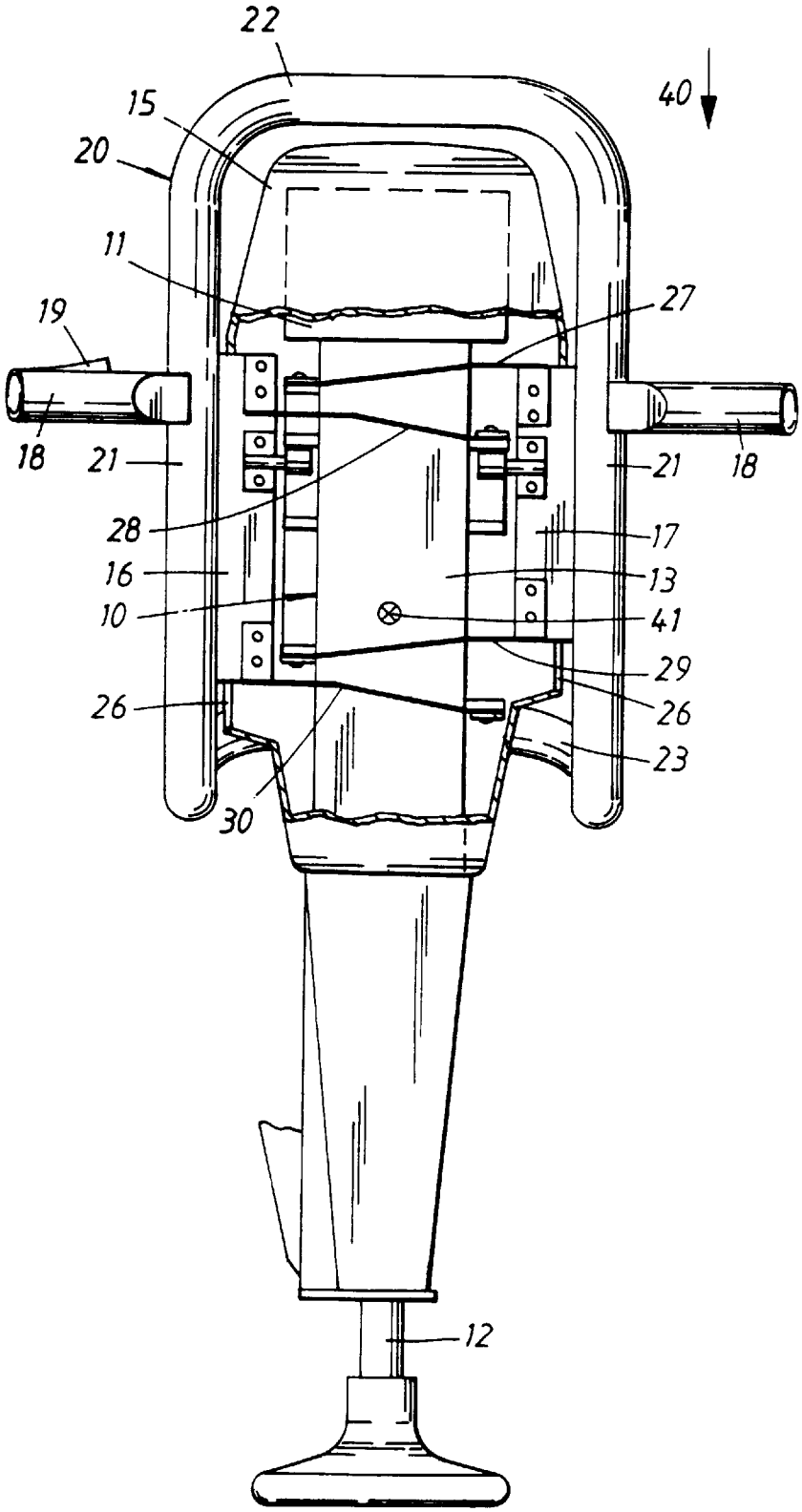
FIG. 1 shows an embodiment represented by a hand held percussive machine, i.e. a breaker machine, viewed from the rear, i.e. from the side of the machine from which the operator controls the machine by the handle frame comprised in the handle means according to the invention. The protective casing is partly sectioned open for showing, in principle schematically, underlying parts.
Figure 5:
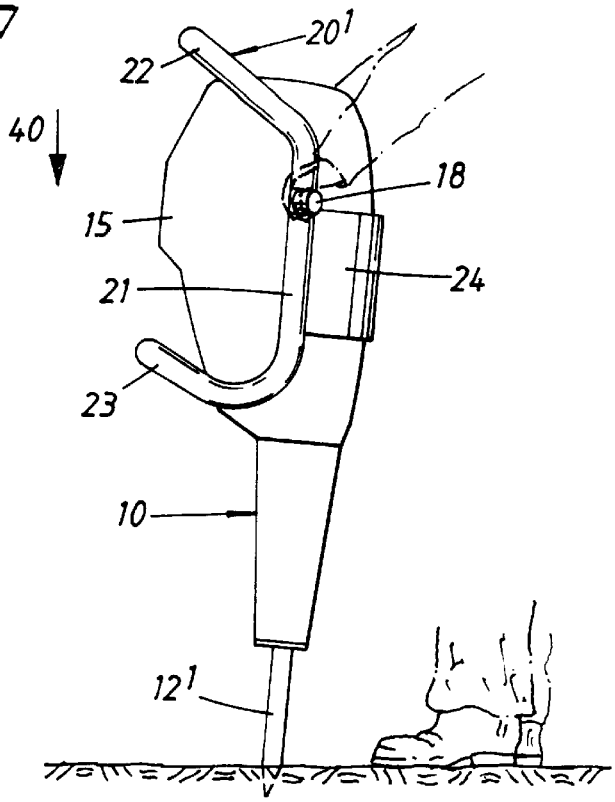
FIG. 5 shows a side view of the handle frame in FIG. 4 mounted on the breaker in FIG. 1 while handled by the operator during work.
Figure 12:
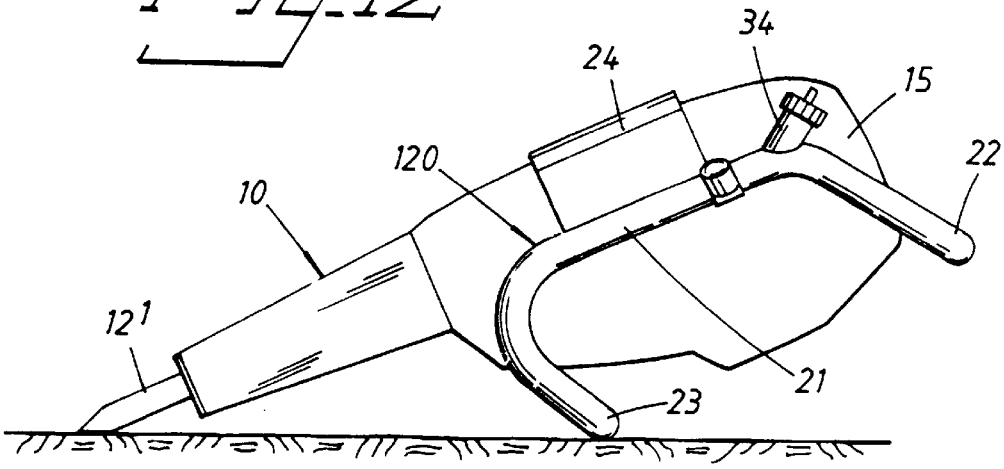
FIG. 12, finally shows, in a side view and somewhat diminished, the breaker lying on the ground in a position for being refueled.

The breaker in FIG. 1 includes a machine housing 10, the greater part of which is enclosed by a fixed protective casing 15 that extends around a schematically indicated drive motor of suitable construction, for example a combustion motor or a motor driven pneumatically, hydraulically or by electric power, as exemplified in the above-mentioned EP patent publication. The drive motor 11 is constructed together with a hammer mechanism 13 which within the machine housing 10 is designed to repeatedly strike a working tool 12 projecting out from the machine housing 10, such as a tamper (FIG. 1), chisel, spade or breaking tool $\mathbf{12}^1$ (FIGS. 5,12). The machine housing 10 and its built-in hammer mechanism 13 may in adapted embodiment suitably be of the type shown in patent publication U.S. Pat. No. 5,052,498.

Manual handling of the breaker is made possible by handle means which surround the part of the machine housing 10 that lies distal from the tool 12 and extend in spaced relation to the protective casing 15, so as to form a handle frame 20 which enables balanced horizontal and vertical alignment of the machine, normally together with the tool 12, relative to the workpiece. The handle frame 20 includes mutually opposing parallel side members 21 which extend along and straddle the machine housing 10 while disposed in a longitudinal plane common therewith. That is, as shown in FIGS. 3 and 4, the two parallel side members 21 are disposed on opposite sides of the housing 10 and extend in a plane (x—x) parallel to a tool application direction. In addition, as shown in FIGS. 2 and 3, each of the two side members 21 has a forward end portion 21*a* located in the tool application direction and a rear end portion 21*b* located in a direction opposite to the tool application direction. The handle frame 20 is shaped by mutually connecting the side members 21 by at least one cross-member, in FIG. 1 shown as two such, an upper and a lower cross-member 22,23 which bridge the interposed machine housing 10 at the opposite ends of the side members 21. That is, as shown in FIG. 2, the cross-member 22 interconnects the rear end portions 21*b* of the side members 21, and the cross-member 23 interconnects the forward end portions 21*a* of the side members 21. As shown in FIG. 4, the cross-member 23 is disposed in a plane (y—y) forming an angle with the plane (x—x) which is parallel to the tool application direction. And as shown in FIGS. 5–8, the cross-member 23 has a larger extent in a direction perpendicular to the tool application direction than the than the housing 10, thereby forming an auxiliary handgrip and protecting the housing 10. A preferred embodiment is to shape the handle frame 20 as an integral arcuate handgrip of plastic material or metal, preferably a closed steel tube. The cross-members 22, 23 are preferably inclined outwardly and in a forward direction away from the machine operator, so as to offer the best gripping position. In this regard, the upper cross-member 22 forms a lifting and machine aligning handle, FIGS. 6,7, at the rear end of the machine housing 10, and the lower cross-member 23 a carrying handle, FIGS. 7,8, by means of which the machine housing 10 during transportation is carried in a horizontal balanced state with said carrying handle 23 located above the region of its intermediate part, in FIG. 8, as evident, in vertical alignment with the center of gravity 41, c.f. FIG. 1, of the breaker. In outward direction laterally extending handgrips 18, of a type common in breakers, are supported by the side members 21 at mutually the same level. In case side members 21 of tubular design are to be used, fastening holes $\mathbf{25}^1$, $\mathbf{25}^2$, $\mathbf{25}^3$ provided by through crosstubes as shown in FIG. 4 illustrate that the handgrips 18 can be fastened by screws to the side members 21 at selective height in order to adapt the working position at the machine housing 10 to operators of different tallness. A throttle lever 19 of appropriate conventional design intended for operationally controlling the drive motor 11 and preferably associated with a Bowden-transmission, is allocated to one of the handgrips 18. By virtue of the operator pushing down on the handgrips 18, the downward tool-feeding force necessary for work is in the usual way applied to the machine housing 10 and is directed in the longitudinal direction of the machine housing 10 and the tool 12 as indicated by arrow 40, FIG. 1.

The side members 21 carry in their common longitudinal plane mutually facing flanges 16, 17 which project into the fixed protective casing 15 via longitudinally extending slots 26. The flanges 16, 17 are secured to the machine housing 10 by suitable vibration damping means, resulting in that the handle means 20 always will be dampened against vibrations when the machine is in use and handled, and the machine housing will be kept mainly balanced in the horizontal plane, FIG. 8. The longitudinal slots 26 in the protective casing 15 are in respect of the vibrations dimensioned so that when the machine is working, the flanges 16, 17 always will be able to move freely and remain vibration-free in said slots, both longitudinally and transversely in relation to the protective casing 15.

In order to avoid harmful rotational vibration and failing directional rigidity, the flanges 16,17 may for example be associated with longitudinal guides or slides in the machine housing 10 as well as with resilient elements such as rubber blocks or steel springs, not shown, inserted between the flanges and the machine housing. For balancing at its best, the vertical projection 41 of the center of gravity of the machine housing should fall into the region between the side members 21 and the outermost vibration damping means at the flanges 16,17. However, in order to avoid transmittal of vibration by the guides, it is preferred, as indicated in FIG. 1, to use at least a pair of leaf springs 27,29 and 28,30, respectively, which are disposed transversely to the feeding direction 40 and form bridges mutually interconnecting the outer portions of the flanges 16,17 on both side members 21 to the interdisposed machine housing 10. The leaf springs 27–30 assure, as a result of them alone, that the vibrations during work will be controlled to describe purely parallel movement without causing contact between the handle frame 20 and the machine housing 10, and assuring sufficient directional rigidity during aligning of the machine housing 10 by the handle frame 20 without the use of interposed sliding supports or guides placed in the feeding direction. This results in high vibration suppression completely unaffected by frictional disturbances. The leaf spring arrangement is described in detail in patent application PCT/SE/00913 filed concurrently with this application and need not be described in more detail here.

Figure 6:
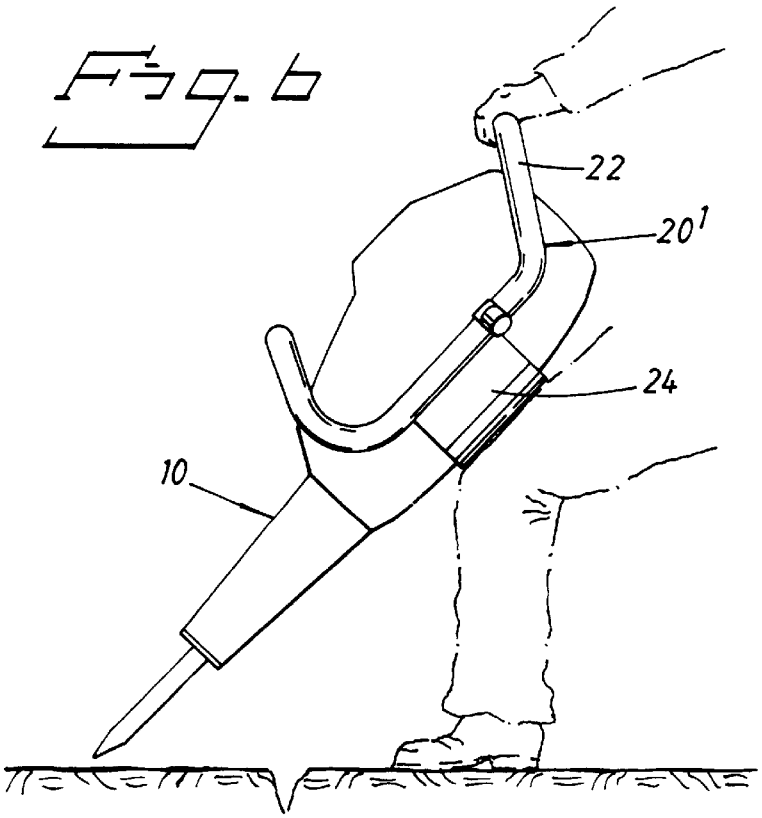
FIGS. 6–8 show, in correspondence with FIG. 5, how the operator handles the breaker, respectively, when moving it to the next working position, at double-handed gripping and lifting it laterally, and when transporting it carried by one hand.
Figure 7:
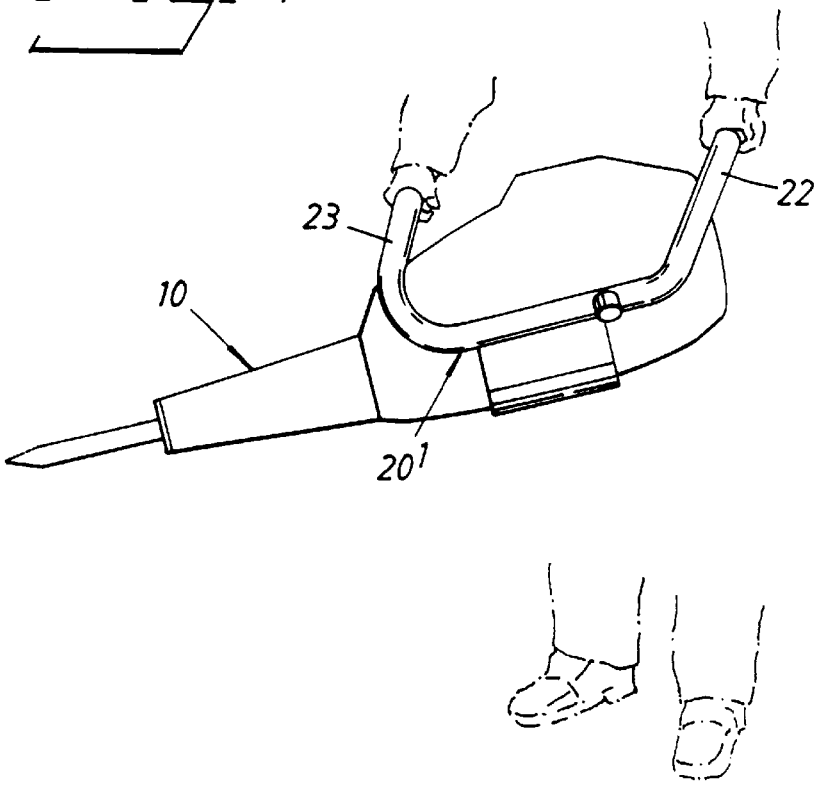
Figure 8:
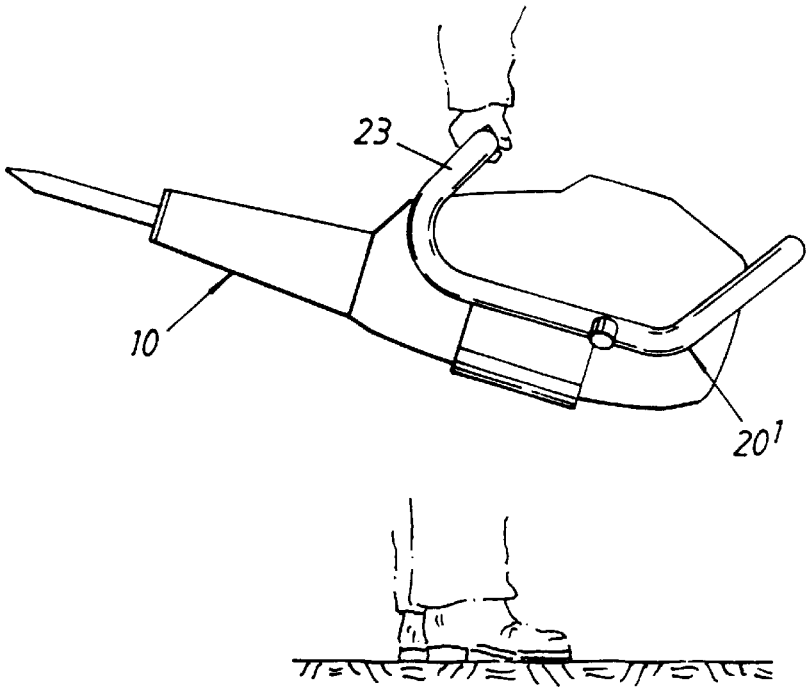
Figure 9:
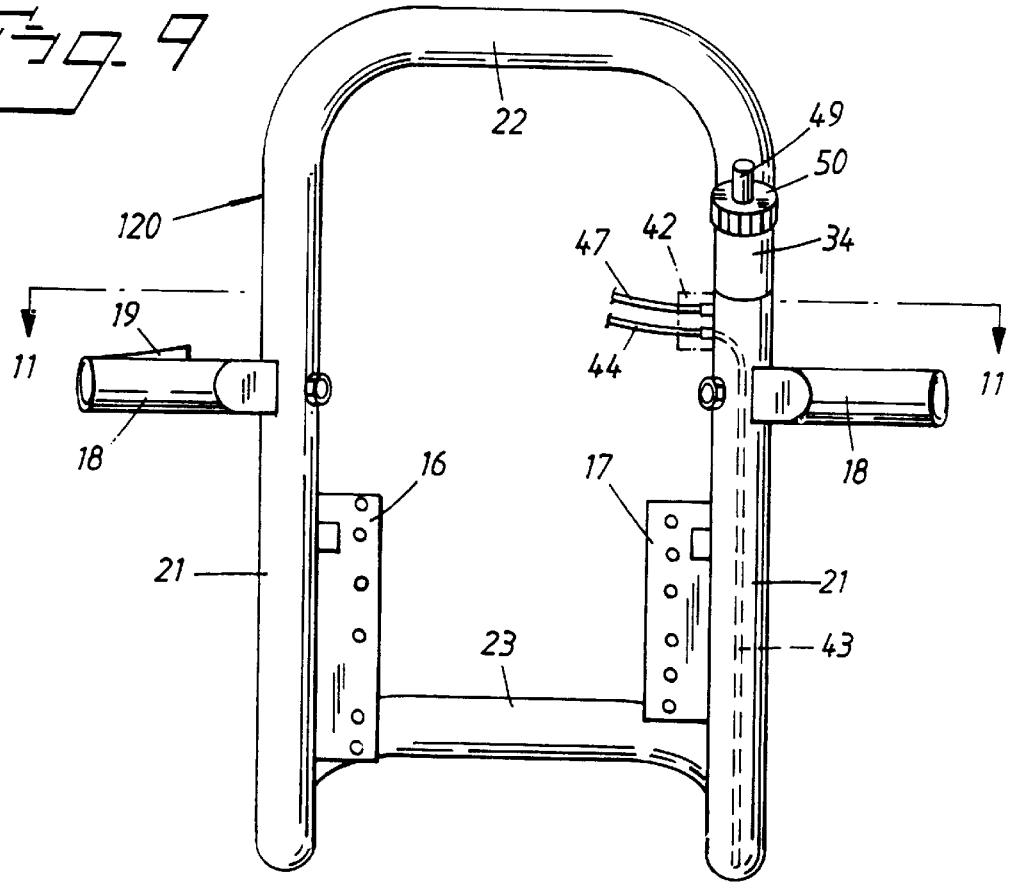
FIG. 9 shows an embodiment of the handle frame apart from the breaker in FIG. 1 and made as a fuel tank in cases when the breaker is driven by a combustion engine.
Figure 10:
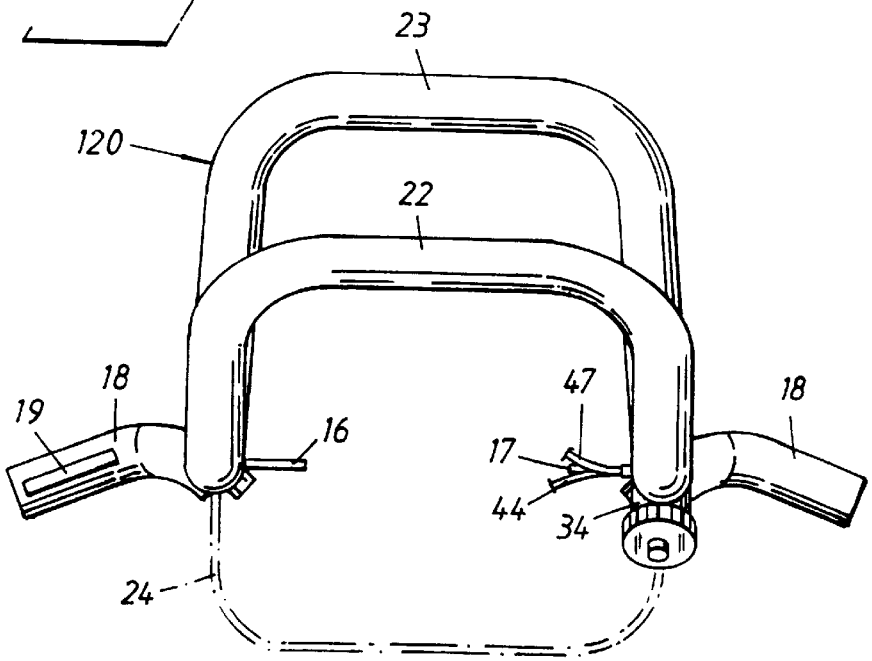
FIG. 10 shows a top view of the fuel tank in FIG. 9 and indicates by broken lines an alternative embodiment corresponding to the one shown in broken lines in FIG. 3.
Figure 11:
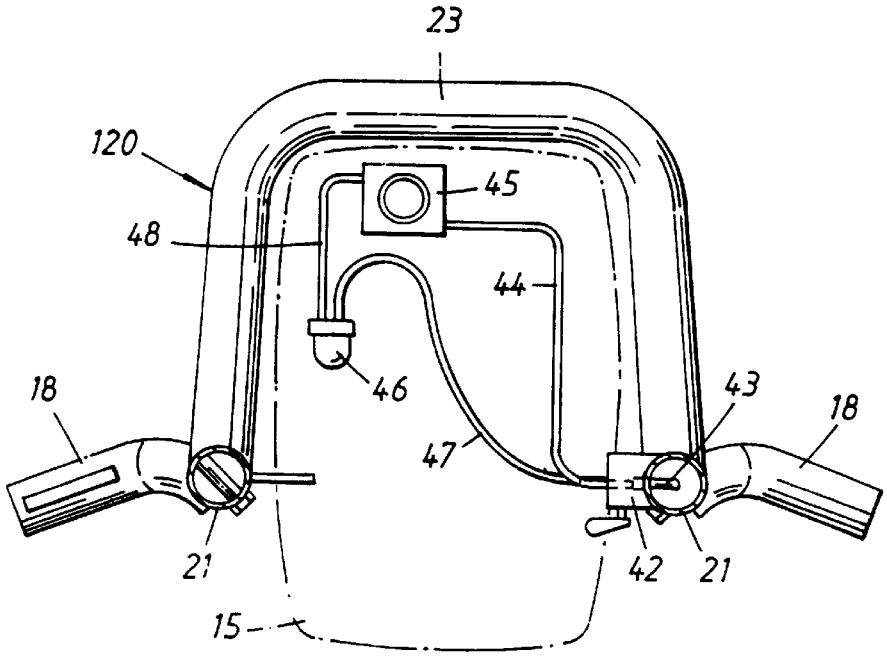
FIG. 11 shows a section on the line 11—11 in FIG. 9 and illustrates schematically the fuel system of the combustion engine.

In the embodiment of FIG. 5 the handle frame $\mathbf{20}^1$ is associated with a third cross-member 24 formed by an arcuate cross-plate 24 directed towards the operator in the working position of the machine housing 10. The cross-plate 24 is connected to the side members 21 in the region of an intermediate portion of the machine housing 10 so as to respectively offer protection, and a pushing surface when the machine housing 10 is to be actuated by the operator's knee for directional adjusting purposes, c.f. FIG. 6 and the broken-line variant in FIG. 3. Thanks to the stiffening influence of the cross-plate 24 on the side members 21, it will be possible in case of need to omit any one or even both of the cross-members 22,23 that are directed away from the operator and nevertheless attain that the side members will function passably as a handle frame.

As an alternative the handle frame 20 can, if desired, carry the protective casing 15 by itself as a part that surrounds but is separate from the machine housing 10, not shown. The casing can in such case, additionally to be protective, be given sound-damping and/or cooling-air leading tasks, and as a part adjacent to the handle frame 20 be supported with full clearance from or partially guided (worsened vibration damping) around or by the machine housing 10. In such case the protective casing, as well, by the aid of the vibration dampening means becomes vibration suppressed in relation to the machine housing 10, and the vibration suppressing counteracting mass will thereby be advantageously increased.

When the novel main build-up of the handle frame 20 in closed tubular shape is to be applied together with combustion engine driven hammering machines, the frame advantageously should be used as a fuel tank mounted separated from the machine for increased safety. In addition to safety one hereby gains that the fuel mass outside of the machine will improve the vibration dampening of the handle system during work, while concurrently therewith the tendency of the fuel to form internal air bubbles due to vibration will be reduced, such bubbles otherwise would disturb motor operation. Such an embodiment is illustrated by the combined fuel tank and handle frame 120, FIGS. 9–12, intended to be mounted on the machine housing 10 instead of the handle frame 20 in FIG. 1.

Outwardly the handle frame 120 is designed in analogy with the handle frame 20 and corresponding parts have in FIGS. 9–12 been given the same numerals as in FIGS. 1–8.

The handle frame 120 thus incorporates a base structure formed by the side members 21 and the handle cross-members 22,23 which jointly are utilized for horizontally and vertically balanced directional alignment of the breaker via the flanges 16,17 in a way described hereinabove and shown in FIGS. 1–8. As before, a further cross member provides leg-protection as an additional option to the handle frame 120. The side members 21 and the cross-members 22,23, i.e. the base structure of the handle frame 120, are formed by a closed pressure vessel designed as a handle-like hand-grippable pressuretight high-strength metal tube, preferably of stainless steel. That tube represents the fuel tank of the breaker and is bent in double arch-shape in order to be able to be placed saddle-like to ride on the breaker as a conveniently round-about grippable handle frame outside the protective casing 15, with the flanges 16,17 coupled to the machine housing 10 via the vibration dampening means 27–30.

At the transition between the cross-member 22 and one of the side members 21 the handle-frame or fuel-tank 120 is associated with a replenishment collar 34 which has a threaded cover 50. The collar 34 is directed rearward-upward relative to the plane of the cross-member 22 in order to enable convenient refueling in upright position of the machine and allows, in case of need, circumferential refueling in slanting upright position at an angle of 45 degrees. Due to the collar 34 pointing to the rear, it will be all right to tank even when the machine rests on the ground, see FIG. 12, with the cross-member 23 and the machine housing 10 or, as the case may be, the breaking tool $\mathbf{12}^1$ as supports.

A suction conduit 43 extends to the lower portion of the handle frame or fuel tank 120 within one of the side members 21. Via an outer nipple and a conduit 44 the suction conduit 44 is connected to the carburetor 45 of the combustion engine 11. A starting pump 46 fills, by suction through a connecting conduit 48, the carburetor 45 by fuel before starting and sucked-in excess fuel is returned to a nipple on the fuel tank 20 via a connection 47.

The base structure 21–23 of the handle frame 120 can, for purposes of more pleasant gripping, be enclosed by plastic (polyurethane) which also decreases outer heating for example by strong sun-light. The overpressure valve 49, FIG. 9, assures release of fuel as a result of an increase in pressure by heat at a threshold value over 0.2 bar, and in normal use prevents outward spill in liquid form. Flooding of the motor 11 when stopped and influenced by inner and outer heat that create overpressure in excess, as well as during motor-transportation in inappropriate position at unintentional fuel transmission to the motor, such behavior can be avoided thanks to the strong pressure resistant metal base structure 21–23 by closing the tank 120 through the medium of a valve 42, FIGS. 9,11. In case of need even the overpressure valve 49 can be designed as a part of the valve 42 and the handle frame or fuel tank 120 can thus be totally shut-off by said valve 42 so that any spill out into the nature will be prevented. Normal plastic fuel tanks would swell under the influence of heat and in the worst case, if old, would risk to burst.

I claim:

1. A handle frame for a portable power tool, wherein said portable power tool comprises a housing, a hammer mechanism provided in said housing, and an elongate working implement having an impact receiving end extending into said housing for receiving impacts in a longitudinal direction from said hammer mechanism, said handle frame comprising:

two parallel elongate side members disposed on opposite sides of said housing and extending in a first plane parallel to a tool application direction, each of said side members having a forward end portion located in said tool application direction and a rear end portion located in a direction opposite to said tool application direction;

mountings provided on said side members for connecting said handle frame to said housing of said portable power tool in a vibration damped manner;

two handgrips laterally extending from said side members for enabling manual support and control of said portable power tool during operation;

a forward arcuate cross-member interconnecting said forward end portions of said side members; and a rear arcuate cross-member interconnecting said rear end portions of said side members;

wherein said forward cross-member is disposed in a second plane forming an angle with said first plane, and said forward cross-member has a larger extent in a direction perpendicular to said tool application direction than said housing of said portable power tool, thereby forming an auxiliary handgrip and protecting the housing of said portable power tool.

2. The handle frame according to claim 1, wherein said rear cross-member has a larger extent in a direction opposite to said tool application direction than said tool housing of said portable power tool, and wherein said rear cross-member is also arranged to form an auxiliary handgrip.

3. The handle frame according to claim 2, wherein said angle formed between said first plane and said second plane is less than 90°.

4. The handle frame according to claim 3, further comprising an intermediate cross-member extending between said side members in a region between said rear end portions and said forward end portions of said side members, said intermediate cross-member comprising an arcuate plate which extends around a part of said housing of said portable power tool in a contact-free manner, and said intermediate cross-member forming a vibration damped support surface adapted to be put in body contact with an operator of the power tool.

5. The handle frame according to claim 4, wherein said side members as well as said forward cross-member and said rear cross-member comprise an integral, one-piece tubing unit.

6. The handle frame according to claim 5, wherein said hammer mechanism of said portable power tool comprises a combustion engine, and said integral, one-piece tubing unit comprises a fuel tank for said combustion engine.

7. The handle frame according to claim 5, wherein said mountings comprise two oppositely directed flanges disposed substantially in said first plane, said flanges being insertable into side openings provided in a protective casing surrounding said housing of said portable power tool, and wherein vibration damping elements are disposed inside said protective casing of said portable power tool.

8. The handle frame according to claim 1, wherein said angle formed between said first plane and said second plane is less than 90°.

9. The handle frame according to claim 1, further comprising an intermediate cross-member extending between said side members in a region between said rear end portions and said forward end portions of said side members, said intermediate cross-member comprising an arcuate plate which extends around a part of said housing of said portable power tool in a contact-free manner, and said intermediate cross-member forming a vibration damped support surface adapted to be put in body contact with an operator of the power tool.

10. The handle frame according to claim 1, wherein said side members as well as said forward cross-member and said rear cross-member comprise an integral, one-piece tubing unit.

11. The handle frame according to claim 10, wherein said hammer mechanism of said portable power tool comprises a combustion engine, and said integral, one-piece tubing unit comprises a fuel tank for said combustion engine.

12. The handle frame according to claim 1, wherein said mountings comprise two oppositely directed flanges disposed substantially in said first plane, said flanges being insertable into side openings provided in a protective casing surrounding said housing of said portable power tool, and wherein vibration damping elements are disposed inside said protective casing of said portable power tool.

* * * * *